US006945262B2

(12) United States Patent
Farr et al.

(10) Patent No.: US 6,945,262 B2
(45) Date of Patent: Sep. 20, 2005

(54) ANALYSIS EQUIPMENT FOR DETERMINING PHYSICAL PROPERTIES OF AN ORGANIC SOLUTION

(75) Inventors: Howard J. Farr, Blue Ash, OH (US); Keith H. Betscher, West Chester, OH (US); Richard R. Worthing, Jr., Cincinnati, OH (US); D Sangeeta, Cincinnati, OH (US); Himanshu B. Vakil, Niskayuna, NY (US); Curtis A. Johnson, Schenectary, NY (US); Thomas J. Cartier, Jr., Scotia, NY (US); Edward B. Stokes, Niskayuna, NY (US); Heinz Jaster, Schenectady, NY (US); Alexander S. Allen, Houston, TX (US)

(73) Assignee: General Electric Company, Schenectady, NY (US)

( * ) Notice: Subject to any disclaimer, the term of this patent is extended or adjusted under 35 U.S.C. 154(b) by 265 days.

(21) Appl. No.: 10/050,660

(22) Filed: Jan. 16, 2002

(65) Prior Publication Data

US 2002/0066470 A1 Jun. 6, 2002

Related U.S. Application Data

(62) Division of application No. 09/425,556, filed on Oct. 22, 1999, now Pat. No. 6,354,310.
(60) Provisional application No. 60/108,072, filed on Nov. 12, 1998.

(51) Int. Cl.[7] ..... B08B 3/08
(52) U.S. Cl. ..... 134/113; 134/111; 134/108; 134/57 R; 134/18; 134/10

(58) Field of Search ..... 134/56 R, 61, 134/105, 107, 108, 109, 113, 10, 111, 57 R

(56) References Cited

U.S. PATENT DOCUMENTS

| | | | | |
|---|---|---|---|---|
| 3,062,223 A | | 11/1962 | Malin et al. | 134/107 X |
| 4,111,715 A | | 9/1978 | Sprengling et al. | 134/10 |
| 5,643,474 A | | 7/1997 | Sangeeta | 216/96 |
| 5,685,917 A | | 11/1997 | Sangeeta | 134/2 |
| 5,690,751 A | | 11/1997 | Hosel et al. | 134/30 |
| 5,722,441 A | * | 3/1998 | Teramoto | 134/56 R |
| 5,779,809 A | | 7/1998 | Sangeeta | 134/2 |

FOREIGN PATENT DOCUMENTS

| | | |
|---|---|---|
| EP | 744233 A2 | 11/1996 |
| WO | 95/07153 | 3/1995 |

* cited by examiner

*Primary Examiner*—Zeinab El-Arini
(74) *Attorney, Agent, or Firm*—McNees Wallace & Nurick LLC

(57) ABSTRACT

Analysis equipment for determining a concentration of an organic component and a caustic component of a reusable organic caustic solution that has been utilized for removing a ceramic coating from a metallic component at elevated temperatures and pressures, such as in an autoclave. Sensors are positioned between a filter for removing particles of the ceramic coating dispersed in the reusable organic caustic solution from the reusable organic caustic solution and a storage tank storing the reusable organic caustic solution after removal from the autoclave. The sensors measure physical properties of the reusable organic caustic solution after removal of the particles from the reusable organic caustic solution, such as electrical conductivity, opacity, refractive index, density, fluidity and the speed of sound in the solution.

18 Claims, 8 Drawing Sheets

ANALYSIS EQUIPMENT FOR DETERMINING PHYSICAL PROPERTIES OF AN ORGANIC SOLUTION

This is a division of patent application Ser. No. 09/425,556, filed Oct. 22, 1999, now U.S. Pat No. 6,354,310, which patent application claims priority to Provisional Application Ser. No. 60/108,072, filed Nov. 12, 1998.

BACKGROUND OF THE INVENTION

1. Field of the Invention

The present invention generally relates to an apparatus and a process for removing ceramic materials from, and cleaning the surfaces of, articles and specifically relates to improved apparatus and processes for removing ceramic material and cleaning loose and tightly bound contamination from the surfaces of airfoil components on a production basis.

2. Description of the Prior Art

U.S. Pat. No. 5,685,917 to Sangeeta entitled "Method for Cleaning Cracks and Surfaces of Airfoils", U.S. Pat. No. 5,643,474 to Sangeeta entitled "Thermal Barrier Coating Removal on Flat and Contoured Surfaces" and U.S. Pat. No. 5,779,809 to Sangeeta entitled "Method of Dissolving or Leaching Ceramic Cores in Airfoils" explain the use of an organic caustic mixture under pressure for the cleaning and removal of ceramic materials such as ceramic cores used in the production of casting gas turbine hardware and thermal barrier coatings used to improve the temperature capabilities of gas turbine hardware. The processes outlined have several problems that must be overcome to practice the technology in production environments with higher throughput. Basically, the patents describe methods of attacking the ceramic materials by exposing them under elevated temperature and pressure to organic caustic solutions comprised of a volatile organic compound, a caustic compound and water.

The reagents involved are highly alkaline and flammable, a combination that renders them particularly difficult to handle. The pressures and temperatures set forth in these patents are high, being elevated well above ambient, thereby causing the entire process to be extended in duration. While this is acceptable for laboratory settings or in small scale runs, it is undesirable in production settings. These prior art processes comprise loading a pressure vessel such as an autoclave, with soiled, coated turbine hardware and adding the caustic reagents. The loaded pressure vessel is brought to the appropriate elevated temperature and pressure, thereby subjecting the coated parts to the caustic reagents which act on the hardware to remove the coating. The pressure vessel is then cooled and depressurized and the stripped hardware is removed from the vessel. The hardware is then removed from the vessel and residual reagents are removed from the hardware. However, these prior art processes are not readily adaptable for the high volumes usually encountered in production situations. The prior art processes do not address the problems of adapting such autoclave equipment, typically designed for batch processing, for continuous production processing. Nor do the prior art processes address the problems encountered in reusing these contaminated and dangerous chemicals.

What is needed are equipment and methods capable of removing ceramic materials such as coatings from coated hardware as the first step in a process for refurbishment and restoration of turbine hardware in an efficient and safe manner, while eliminating contamination from the reagent to allow reuse.

BRIEF SUMMARY OF THE INVENTION

The present invention is directed to a combination of equipment that provides apparatus and a method for conveniently removing ceramic coatings from, and cleaning the surfaces of articles using a caustic solution such as an alkaline hydroxide. This invention provides the ability to process a large quantity of articles in a short period of time while providing the capability to reuse the caustic chemicals for multiple cycles of article processing.

The apparatus of the present invention includes means for storing the caustic solution until it is ready for application to the articles. When ready for use, the caustic solution is preheated to a first preselected temperature by a means for preheating. The means for preheating may be a separate chamber or may be a device such as a heating coil which elevates the temperature of the solution as it exits the means for storing. The caustic solution is then pressurized to a first pressure by a means for pressurizing. The pressurization may be accomplished in the same device as the preheating. The pressurization may be performed in conjunction with the preheating. The caustic solution, preheated to a first temperature and pressure is now introduced into a pressure vessel by a suitable means for introducing and transferring the caustic solution. As will become clear, the processes of the present invention result in the pressure vessel being at an elevated temperature above ambient. The pressure vessel, prior to introduction of the heated, pressurized caustic solution, is loaded with the articles which are to be processed. These articles require processing to remove or strip ceramic coating as a first step to reprocessing. As the hardware has typically been utilized in a gas turbine, not only must the ceramic coating be removed, but also undesirable materials, such as loose contamination including soot and other by-products of fuel combustion, and tightly adherent oxides resulting from the high temperatures of combustion, must be removed.

The pressure vessel has an internal volume that is substantially larger than any of the articles which are to be stripped and also has the capacity to receive a substantial amount of caustic solution. The pressure vessel also has the ability to achieve pressures and temperatures well in excess of ambient. After a plurality of articles are loaded into the pressure vessel and the caustic solution at a first elevated temperature and pressure have been introduced into the hot pressure vessel, the vessel and its contents may require some minor heating to equalize the temperature of the vessel and its contents at the first elevated temperature, as some heat may be lost during the loading and unloading processes. In an optional embodiment, the pressure vessel and its contents may be heated to a preselected second elevated temperature above the first preselected temperature by a second heating means. The pressure vessel also may be raised to a preselected second elevated pressure above the first preselected pressure.

The pressure vessel and its contents are then held at temperature and pressure for a sufficient time to permit the caustic solution to interact with the surface of the articles so as to either remove the materials overlying the substrate or to weaken such materials substantially so that they can be removed with little additional effort, while not otherwise affecting the article substrate. After sufficient time at pressure and temperature has passed to accomplish the desired result of stripping or substantial weakening of materials on the substrate of the article, the caustic solution is removed from the pressure vessel by a suitable means for removing the solution. Of course, the removal of the solution may cause a drop of pressure in the vessel. The caustic solution is then cooled by a means for cooling after its removal from the pressure vessel. After cooling to a suitable temperature, the solution can then be safely transferred to the means for storing the solution, until the next cycle of operation is ready to commence.

The articles within the pressure vessel may now be removed for further processing, while the pressure vessel remains hot. However it will be necessary to rinse the caustic solution from the articles after stripping. This is accomplished by use of a second vessel and introduction of a suitable reagent, which can include water. The reagent will also serve to sufficiently cool the articles so that their removal from the second vessel can be expedited without substantially lowering the autoclave temperature.

Improvements in manufacturing technology and materials are the keys to increased performance and reduced costs for many articles. Here, continuing and often interrelated improvements in processes and materials results in the ability to remove materials overlying a substrate, which substrates typically are expensive alloys, without harming the underlying substrate. This allows for improved ability to refurbish articles without adversely affecting the engineering properties of the articles.

An advantage of the present invention, therefore, is an improved ability to remove ceramic coatings from expensive articles without adversely affecting the underlying articles. The articles can thus be refurbished without any impact on the engineering properties of the articles. This in turn increases the useful life of the articles and avoids the need to prematurely replace the articles with expensive new articles, thereby conserving scarce resources.

Another advantage of the present invention is the ability to reuse and recycle caustic solutions. By reuse, not only is the cost of replacing the caustic solutions avoided, but the disposal of the caustic solution is avoided, thereby contributing to an improved environment.

Still another advantage of the present invention is that highly alkaline and flammable reagents that are difficult to handle can now be used in the processing of articles in a production environment at elevated temperatures and pressures safely and with minimal human contact.

Still another advantage of the present invention is the ability to reduce the cycle time for stripping or cleaning. The present invention maintains the pressure vessel at a substantially elevated temperature as parts are cycled through it, thereby eliminating cool down cycles. This eliminates the substantial heat up time for the pressure vessel which typically has a large thermal mass. While shortening cycle time, it also reduces energy consumption, both of which translate into cost savings.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
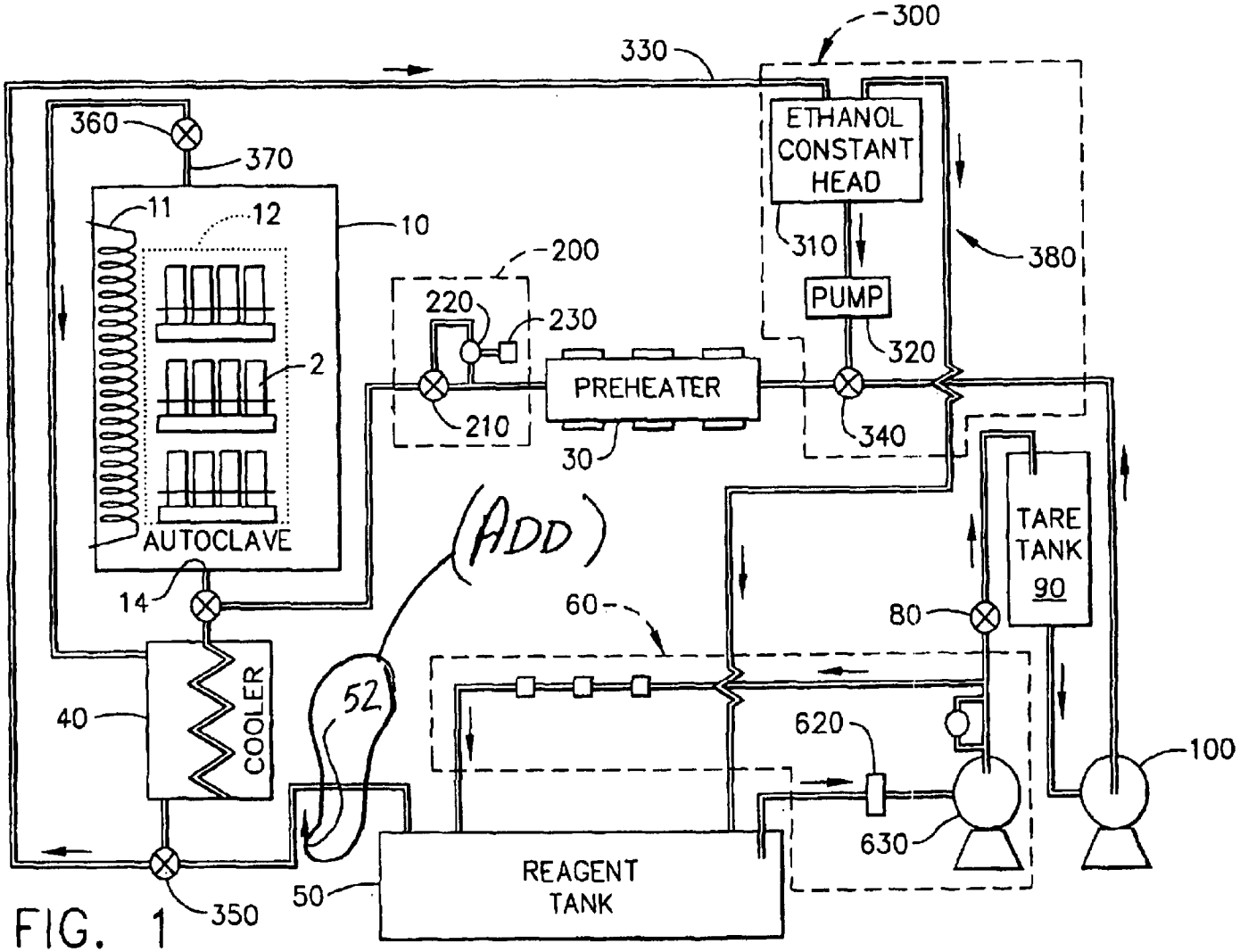
FIG. 1 is an overall schematic of the present invention, showing a general flow of materials through the various systems and apparatus that forms the continuous loop of the stripping and cleaning process.

Referring now to the general schematic of the present invention as shown in FIG. 1, an autoclave 10 is utilized that remains substantially at the elevated temperature required for removal of coatings such as the ceramic coatings used for thermal protection in gas turbine applications on articles such as combustors, airfoils, both as blades and vanes and other turbine hardware. Because the autoclave is a pressure vessel, it must meet structural requirements to contain high pressures. As a consequence, it is of large thermal mass, so that by keeping autoclave 10 as close to the elevated temperature required for coating removal as possible, the cycle time for vessel heat-up is substantially reduced or eliminated.

To further reduce the cycle time for processing hardware, a high pressure pump 100 is used to force the chemical reagent through a pre-heater 30 and into pre-heated autoclave 10. After the turbine hardware, represented as turbine airfoils 2 in FIG. 1, has been stripped, the high pressure pump assists in removing the reagent from autoclave 10 through a cooling means 40 so that the temperature and pressure of reagent 52 are ultimately and quickly reduced to a safe level, preferably ambient.

The reagent 52, after use to remove materials attached to the substrate, typically contains particles of the stripped coating as well as any other contamination such as oxides, insoluble dirt or loose products of combustion and soluble deposits that may have been deposited on the turbine hardware. However, the reagent 52 may be reused for a plurality of stripping operations upon proper conditioning. This conditioning involves removal of particles and adjustment of the reagent chemistry. The larger solid particles are first removed from the contaminated reagent by simply filtering the reagent through a mesh screen 12 located between the parts and cooling means, but preferably located within the autoclave. The reagent 52 then passes out of the autoclave and through cooler means 40 and into reagent tank 50 used for storage. Although not shown, additional filters may be included at any point between the autoclave exit 14 and reagent tank 50. Reagent 52 is further filtered through a continuous circulation loop 60 where further filtering of the reagent occurs and through an analysis loop in which the chemistry of the reagent is sampled. For convenience in FIG. 1, the circulation and analysis loop are shown consolidated into one loop, which is the preferred embodiment. However, it will be understood that the continuous circulation loop and the analysis loop may be physically separated within the system.

From the reagent storage tank, the reagent is transferred to a metering means 90 where the proper amount of reagent 52 required for use in autoclave 10 is determined. Reagent is then transferred to pre-heater 30 by a high pressure pump 100. A loop 200 is placed into the system in order to create a back pressure in pre-heater 30 and prevent salting-out. In FIG. 1, loop 200 is shown for illustration purposes as a separate loop. However, it is understood by those skilled in the art that loop 200 can be designed as an integral part of pre-heater 30. Also shown in FIG. 1 is an injection system 300 that is used to pressurize the autoclave with a volatile fluid prior to introduction or reagent 52. The injection system includes apparatus to remove the volatile from the autoclave 10 accomplishing a reduction of pressure, while additionally condensing it, thereby separating it from reagent 52 and transferring the volatile to a storage device where it can be reused.

Autoclave 10 may be any pressure vessel of convenient size capable of receiving articles within a chamber. The autoclave must be capable of maintaining both a pressure well above ambient as well as an elevated temperature. Autoclaves are well known in the art as is the fact that pressures can be related to temperatures. The minimum pressures and temperatures that an autoclave must be capable of maintaining in order to practice the teachings of the present invention are about 500 psi and 350° F. The autoclave used to practice the present invention has a pressure rating of 1000 psi and a temperature rating of 480° F. These ratings are above the actual pressures and temperatures used, which preferably are about 750 psi at temperatures of about 465° F. using a preferred reagent solution, including a volatile, having a composition by weight of about 60% ethanol, about 15% sodium hydroxide and the balance water. Of course, it will be understood by those skilled in the art that when lower temperatures and pressures are used, longer dwell times within the autoclave are requires to remove the material from the substrate surface, and this undesirably increases the dwell time. Thus, shorter cycle times, achievable by higher temperatures and pressures, are desirable. It will also be understood that changing the reagent solution can also affect the dwell time as well as the temperatures and pressures actually used. Even though the preferred volatile organic used was ethanol, it will be understood that other volatile organics such as methanol, trichlor-ethane, acetone, amides, etc. may be substituted for ethanol. Also, other alkaline hydroxides such as potassium hydroxide also known as caustic potash may be substituted for the preferred caustic soda, sodium hydroxide.

Figure 2:
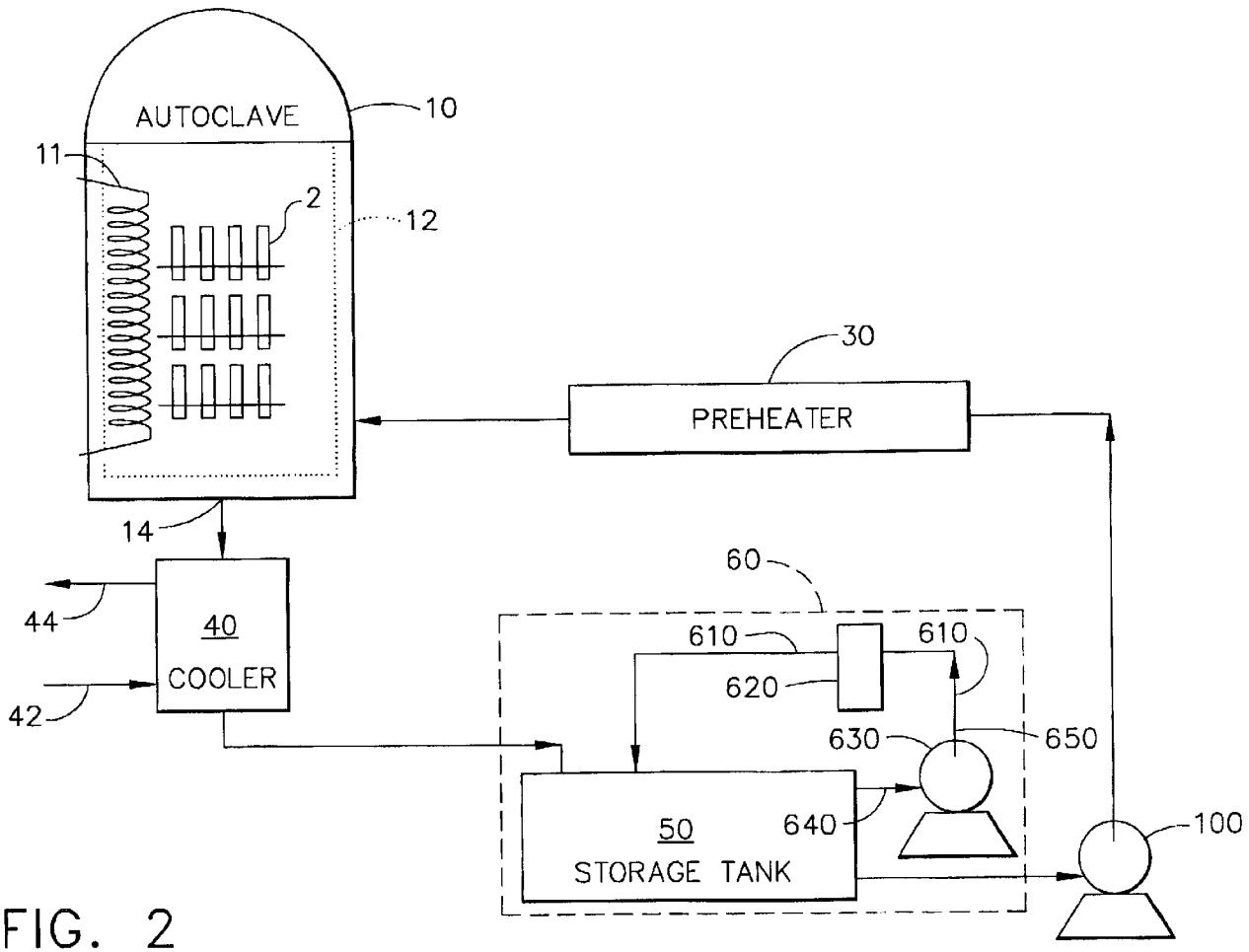
FIG. 2 is a detailed schematic of the in-vessel filtration system of the present invention.

FIG. 2 depicts the filtration system used in conjunction with the major components of the system including autoclave 10 loaded with airfoils 2. Within autoclave 10 is a filter or mesh screen 12 for removing very large particles. As shown, mesh screen 12 surrounds airfoils 2 so that screen 12 captures large segments of coating as they separate from the airfoils. It will be understood by those skilled in the art that mesh screen 12 does not have to surround the articles as shown in FIG. 1 and may be located at any position between airfoils 2 and the exit to the autoclave 14. Furthermore, to adequately filter the particles of ceramic, which will not be of uniform size, a series of meshes, each succeeding mesh of correspondingly smaller mesh size may be used. The mesh or meshes are ideally arranged around the fixtures holding the hardware to filter the reagent prior to exiting the autoclave. Particles smaller than a given mesh will pass through to the next mesh in the series, while larger particle are captured by the mesh for subsequent removal. Although the mesh screen can be any size, the size must be determined based on the amount of time required to drain autoclave 10 and the size of particles permitted to leave autoclave 10. In a preferred embodiment, only small particles are passed from the autoclave. In the best mode of practicing the present invention, a single mesh screen having a size of −1/16" was used, which means that particles smaller than 1/16" were allowed to pass from the autoclave into the cooler, larger particles being captured by mesh screen 12 being captured by the screen. Also shown are a pre-heater 30, a storage tank for reagent 50, a cooling means 40 in the form of a heat exchanger having an inlet line 42 for cooling water and an outlet line 44 for the water.

Attached to storage tank 50 is an isolatable filtration circulation loop 60 that includes a pipe 610 that provides communication for reagent 52 to a pump 630 through a filter 620 and then back to the tank. Reagent 52 continuously enters into pipe 610 and is passed through a filter 620 by circulating pump 630 having an inlet 640 and an outlet 650. It will be understood that depending on the extent and effectiveness of filtration of reagent 52 after use in the autoclave by mesh screen 12, filter 620 may be positioned on the inlet 640 side of circulating pump 630 which will draw reagent through filter 620, if the particles are sufficiently large that they will impede or block the flow of reagent 52 through pipe 610 or pump 630. Reagent 52 can then be returned to reagent storage tank 50 as shown in FIG. 1, preferably where cooler 40 drains into tank 50.

Figure 3:
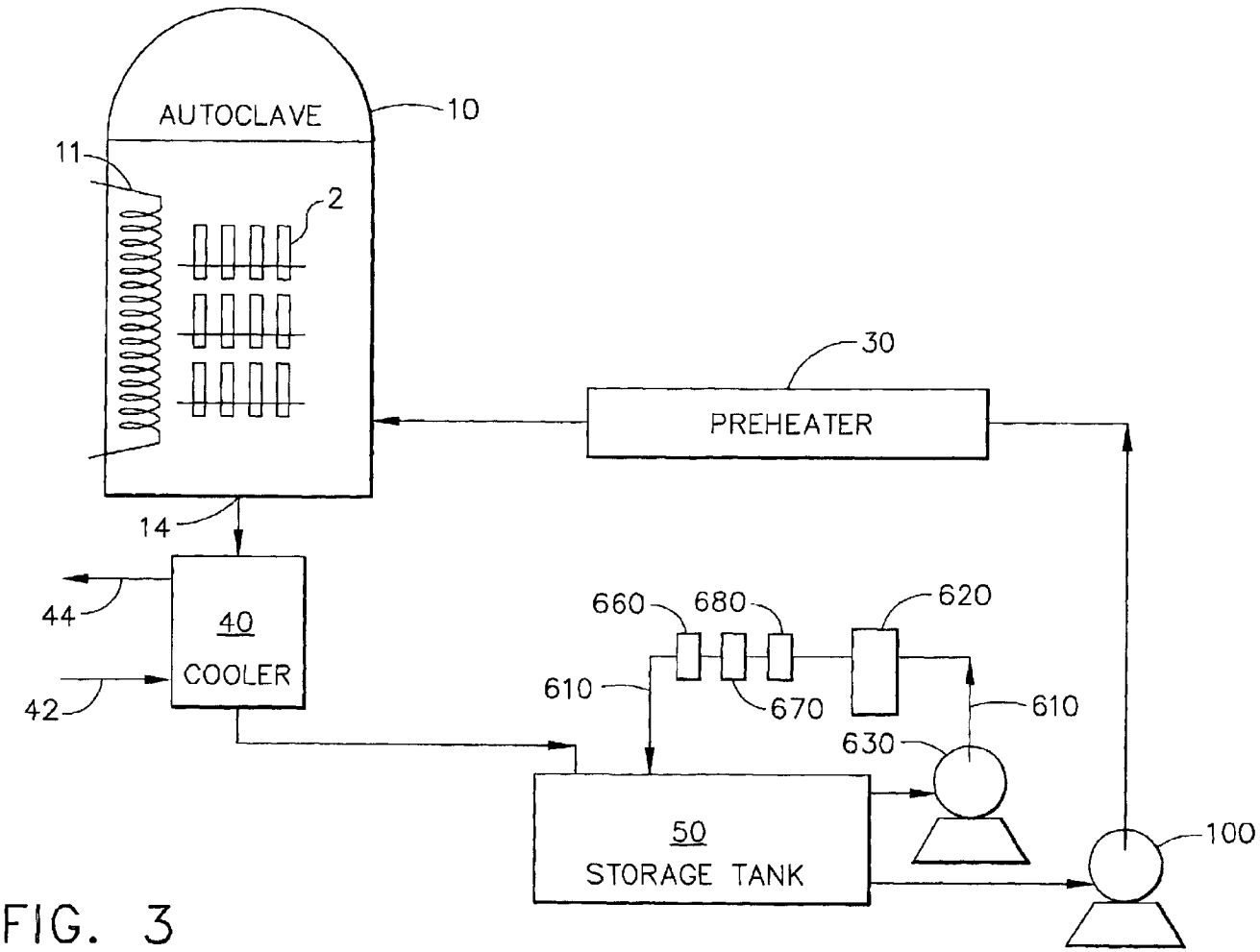
FIG. 3 is a detailed schematic of an exemplary analysis system of the present invention shown as integrated into the filtration loop.

In addition to removing solids from the reagent, it is also necessary to analyze the chemistry of the reagent to assure that it is appropriate for reuse to accomplish the desired results. The chemistry of the reagent may be analyzed by any of a number of techniques, but physical property measurement is preferred. FIG. 3 depicts analytical devices in the preferred embodiment as part of filtering loop. It is not necessary that these analytical devices be included as part of the filtering loop. The analytical devices may be connected to the system at any location to sample reagent, and they may be connected as an independent loop. However, it is preferable that the analytical devices be connected to the reagent storage tank 50, as reagent 52 contained therein can be readily adjusted if the physical properties are found to vary outside of acceptable ranges. The chemistry of reagent 52 can be determined by using equipment or meters to measure or monitor two or more of its physical properties, including, among others, the speed of sound 660, in the solution, the electrical conductivity 670 of the solution, the density 680 of the solution, opacity (not shown), refractive index (not shown), spectroscopic transmission (not shown) and fluidity (not shown) of the solution. Very accurate measurements can be made if at least two of the properties measured respond in inverse manners. For example, if the velocity of sound decreases with increasing sodium hydroxide content, which is also an indication of increasing alcohol level, and density rises with increasing sodium hydroxide content, then the changes in these properties effectively can be linked to chemistry changes in reagent 52. As shown in the embodiment of FIG. 3, representative measurement equipment is shown positioned downstream from filter 620. This is to ensure that measurements are minimally unaffected by suspended solids. Additional equipment measuring any of the properties noted above may be added or substituted for the equipment depicted. Other probes capable of measuring other physical properties also can be substituted or added as needed. The probes can be attached to readouts (not shown) that can provide for continuous monitoring or for periodic sampling of the physical properties. The readouts can be analogue or digital and may be connected to a digital device, such as a computer, if desired. Various arrangements for monitoring can be used. The measured values can be stored in storage medium for later analysis. Alternatively, warning alerts can be sounded if acceptable limits are exceeded. However, it is not the purpose of this invention to explore the various aspects of the measuring equipment and the analysis of data gathered from the measuring equipment. The significant aspect of the invention is the attachment of the measuring equipment to monitor the chemistry of the solution in order to assure that the proper chemistry is maintained as part of the system.

The ratio of the volume of liquid reagent to the volume of vapor space above the liquid within autoclave 10 is important to the efficacy of the process. Once autoclave 10 has been loaded with articles, such as airfoils 2, less reagent 52 is required to be transferred into the autoclave to achieve the desired ratio. Alternatively, when fewer articles are loaded into autoclave 10, more reagent 52 is required. Thus, there is an optimum fill level required for the system in order to achieve the optimum results. However, ascertaining the proper levels is a difficult task since the pressure vessel is closed when the preheated, pre-pressurized reagent is transferred in autoclave 10. A typical solution is to employ a level sensor within the autoclave and transfer sufficient reagent into autoclave 10 until the level sensor indicates that the required level has been achieved. However, because the autoclave is hot, even though the reagent is preheated and pre-pressurized, it is cool in comparison to the autoclave. Thus, the reagent has a tendency to flash into vapor upon introduction into the autoclave. As fill continues, an unstable level results from the cycle of vaporization and condensation resulting in unreliable readings from the level indicator. Another factor contributing to the unreliability of the level indicator is the tendency of hot caustic reagents to attack available instrumentation.

An effective method for controlling the level of reagent is to measure the required quantity of reagent 52 before transferring it to autoclave 10. The volume within autoclave 10 is fixed and known. The weight of the parts can be readily determined. The parts entering the autoclave can quickly be measured on a scale. Alternatively, for repetitive parts such as turbine blades or vanes, the average weights are known as are the part densities and mass. Thus, when all parts of the same design are to be stripped and the part design is known, the volume of the parts can be estimated accurately by knowing the number of number of parts. Since the volume of autoclave 10 is already known, a simple calculation provides the amount of reagent 52 required to achieve the required level within autoclave 10. This volume of reagent 52 can accurately be supplied to the pre-heater use of a constant displacement pump, not shown in the figures. The pump is isolatable from the pre-heater once the required amount of reagent has flowed through it.

Figure 4:
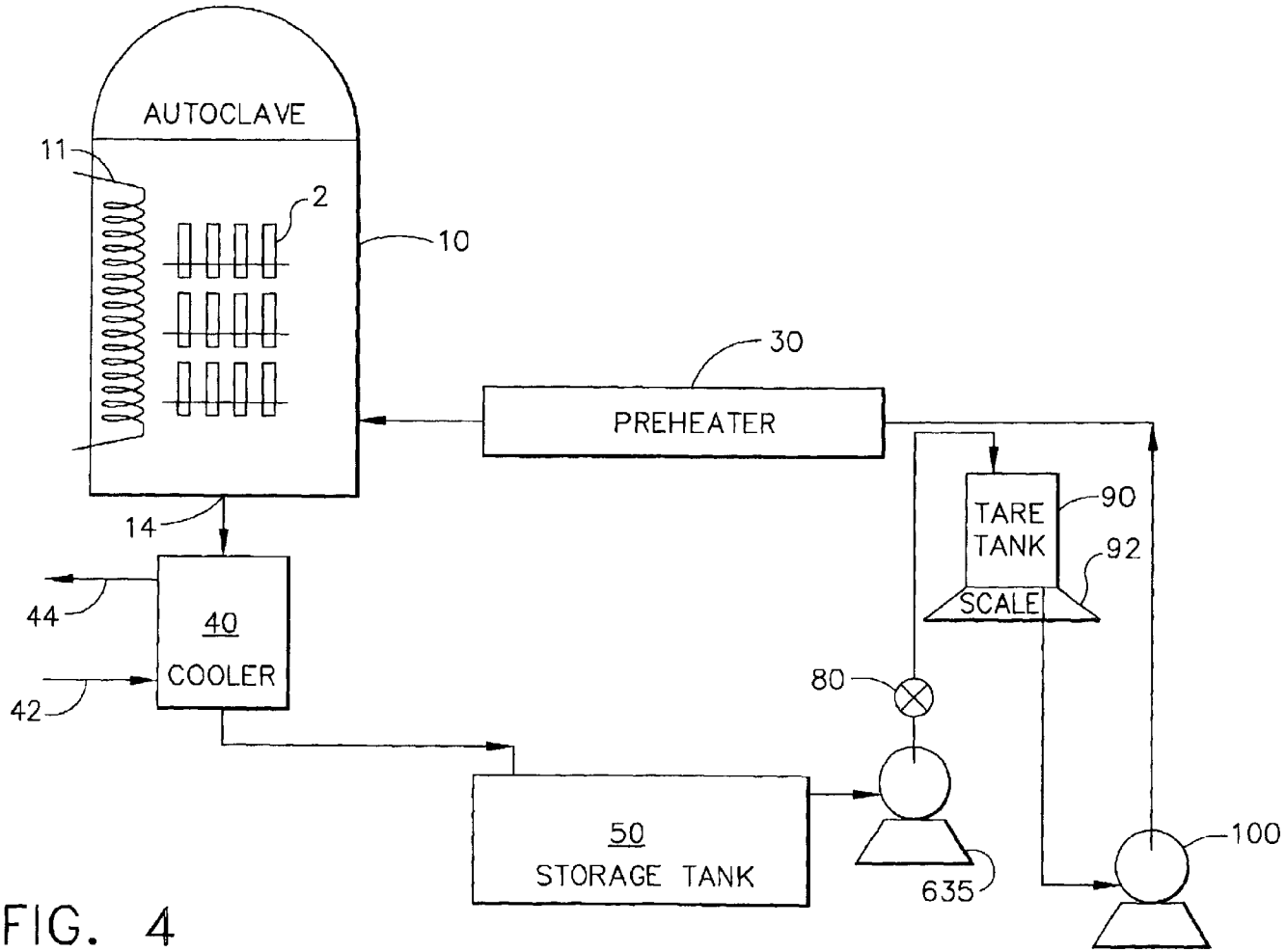
FIG. 4 is a detailed schematic of a reagent mass dispensing system.

An alternative scheme for providing the required volume of reagent 52 to the autoclave is set forth in FIG. 4. Pump 635 is energized to pump reagent to tare tank 90. When the required amount of reagent has been pumped into tank 90, the pump can be de-energized. Alternatively, a valve 80 may be located on the outlet side of pump 635, which is switchable between open and closed positions so that, when opened pump provides reagent 52 to tare tank 90. When sufficient reagent has been supplied to tare tank 90, valve 80 is closed. Valve 80 also may be situated as shown in FIG. 1 switchable between the return pipe in the circulation loop to the reagent tank and the pipe to tare tank 90. In this embodiment, only one pump, shown as 630 in FIG. 1, is required for both circulating reagent 52 in loop 600 and for providing reagent to tare tank 90. However, the manner of providing fluid to either tare tank 90 or a constant displacement pump is not important, as long as it can be oriented to stop the flow of reagent to the metering devices once the required volume is achieved. Reagent 52 can be drawn directly from tank 50 when it has been sufficiently filtered.

The proper level of reagent required in tare tank 90 can be determined by level sensors, which will function properly when reagent 52 is at or close to ambient temperature. However, as shown in FIG. 4, tare tank 90 is on a scale 92 to measure reagent weight. Since density and mass of reagent are known, the volume can be determined by weight. When the required weight is achieved, reagent flow to tare tank is stopped. Of course, if there is any question about the accuracy of either method, both a scale and level sensors can be used to monitor the reagent volume, the methods acting as cross-checks on one another. Reagent 52 is then pumped from tare tank 90 by high pressure pump 100 to pre-heater 30.

As reagent 52 is pumped by high pressure pump 100 from one of the metering device used to control the required volume to be transferred to autoclave 10 by way of pre-heater 30, the cool reagent 52 comes into contact with the hot surfaces of the pre-heater. If no back pressure is developed in the system, at least a portion of the solvent in reagent 52 will vaporize, causing an increase in concentration of caustic soda in the reagent. This can lead to a deposit of solid caustic soda in the pre-heater. This phenomenon is undesirable and is referred to as "salting-out". Salting-out can eventually lead to a blocking of the passage way through the pre-heater, which will shut down the process. Salting-out can also adversely affect the preheating operation. As the caustic soda is built up within the pre-heater, heat transfer is adversely affected, so that reagent 52 is not preheated to the correct temperature, or alternatively, the time to reach the required temperature is increased. When electric heating elements or coils are utilized in pre-heater 30, the build-up of deposit can shorten the life of these devices causing premature failure.

Figure 5:
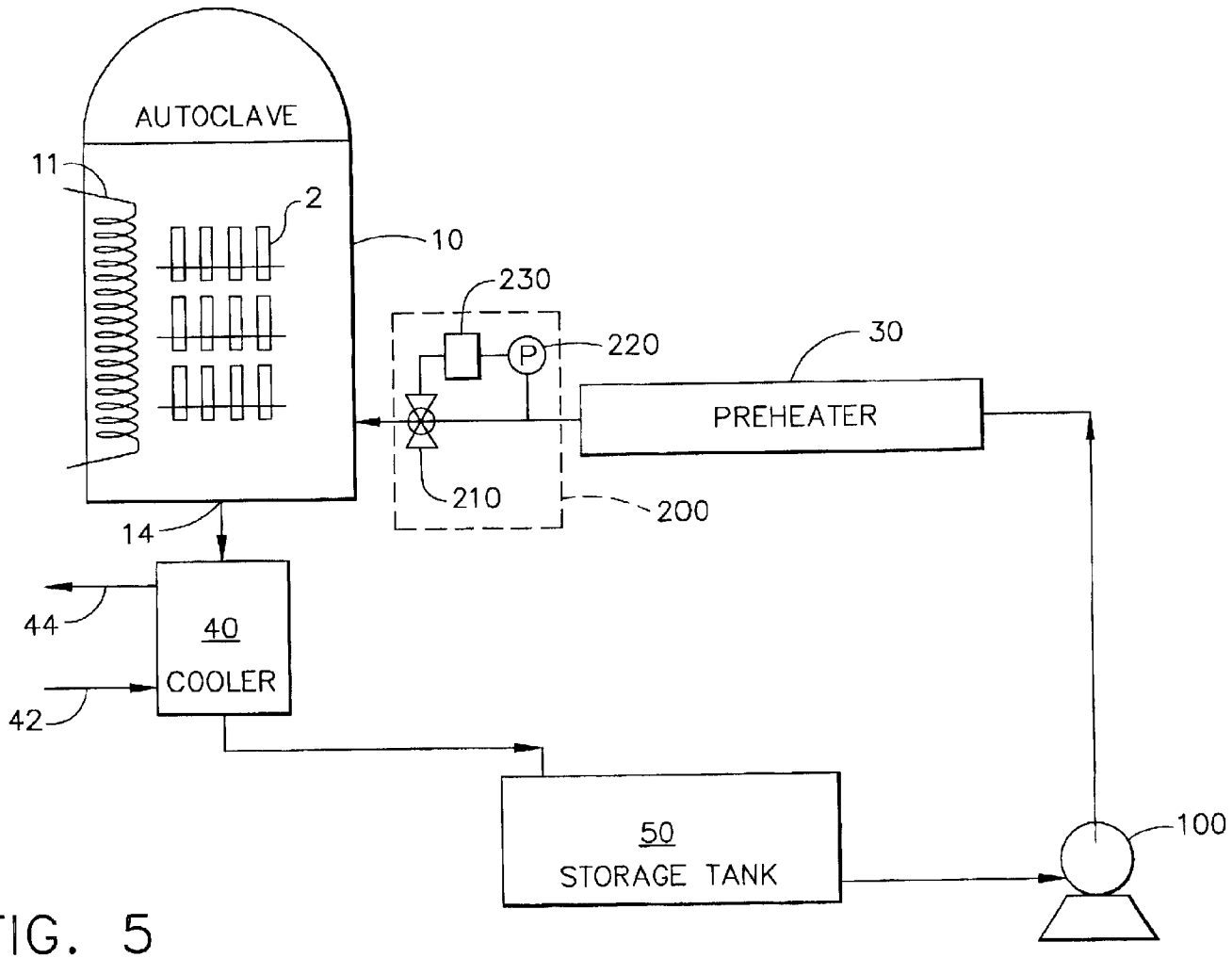
FIG. 5 is a detailed schematic of a back-pressurization system.

To minimize the problem of salting-out, a back pressure can be formed in the pre-heater. Referring to FIG. 1 and shown in more detail in FIG. 5, a back pressure loop 200 is placed into the system. Although this loop is shown in the system between the autoclave and the pre-heater, it can be designed as an integral part of pre-heater 30. The purpose of loop 200 is to create a back pressure in pre-heater 30 to reduce the tendency of solvent in reagent 52 to vaporize as it contacts hot surfaces of pre-heater 30. The loop includes a variable orifice valve 210, a pressure sensor 220 and a PID controller 230. Valve 210 is preferably positioned as closely as possible to autoclave 10. During the preheating cycle, valve 210 is partially closed to create a back-pressure on the inlet side of valve 210 in the line that includes pre-heater 30. A reduced amount of flashing will occur across valve 210, but it will occur on the outlet side of valve 210 that includes autoclave 10. Thus, when valve 210 is positioned close to autoclave 10, the effects of salting-out will be minimized. Pressure sensor 220 monitors the pressure in the pre-heater 30. PID controller 230 automatically controls the opening of valve 210 in response to a signal from sensor 220 indicative of the pressure. In this way, the pressure in pre-heater 30 can be maintained within prescribed pressure limits to minimize or eliminate the vaporization of the solvent portion of reagent 52. Once a sufficient volume of volatiles has passed into autoclave 10 to fully pressurize it, a signal from the autoclave controller (not shown) indicative of this condition can be sent to PID controller 230 which then provides an instruction causing valve 210 to open fully thereby relieving back pressure, since flashing will no longer be significant.

Figure 6:
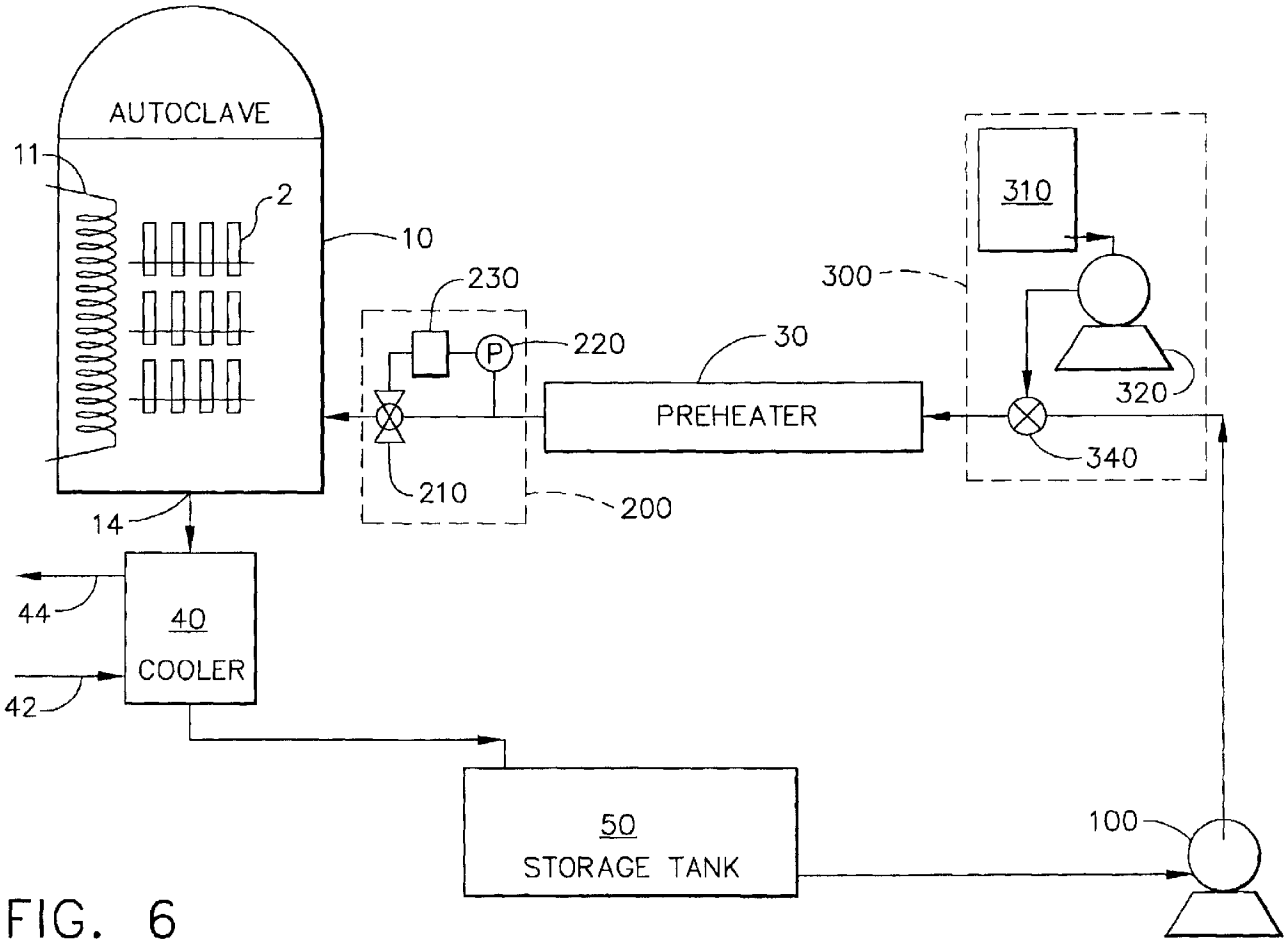
FIG. 6 is a detailed schematic of a volatiles pre-pressurization system.

Another method of addressing the problem of salting out that can be used in conjunction with back pressurization of pre-heater 30 by loop 200 is use of a volatiles injection system. Referring to FIGS. 1 and 6, a volatiles injection system represented by 300 is provided consisting of a volatiles storage tank 310 that maintains a constant head, a pump 320, and a first valve 340 switchable from a first position that connects a volatiles constant head storage tank 310 to pre-heater 30 while isolating reagent from pre-heater 30 and a second position that connects reagent from tank 50 while isolating the volatile fluid from constant head storage tank 310. FIG. 6 includes back pressurization loop 200, and therefore represents the preferred arrangement for practicing the invention. However, it will be understood by those skilled in the art that either system alone can be used to address the problem of salting out. However it is advantageous to use both systems in combination as cycle time can be reduced.

A small quantity of pure, volatile fluid, preferably ethanol, can be used to pressurize the autoclave prior to addition of reagent 52. While the volatile fluid will affect the chemistry of reagent 52, the quantity of volatile actually required is so small that its effect on chemistry is marginal. A predetermined amount of volatile fluid sufficient to pressurize the autoclave is supplied to pre-heater through valve 340. The required volume of fluid, preferably ethanol, can be provided by use of constant displacement pump 320 as shown in FIG. 6, or by filling constant head tank 310 to the appropriate level, which may be controlled by use of level indicators (not shown). Valve 340 is closed after the required volume has passed through it. The volatile fluid passes through pre-heater 30 where it is volatilized and passes into autoclave 10, pre-pressurizing it. The use of ethanol injection system speeds the pre-pressurization of autoclave 10 since pre-pressurization is accomplished by volatilizing a small amount of a volatile fluid as compared with the use of a significantly larger amount of reagent to accomplish pre-pressurization when only reagent is passed through pre-heater using loop 200. Of course, in one embodiment, loop 200 can further prevent salting out which can still occur due to minor fluctuations in pressure and temperature as the cold reagent is introduced into pre-heater 30. After loop 300 is isolated from pre-heater 30 by valve 340, a metered amount of reagent 52 can then introduced into pre-heater from pump 100 and into autoclave 52 by any of the methods previously set forth.

Figure 7:
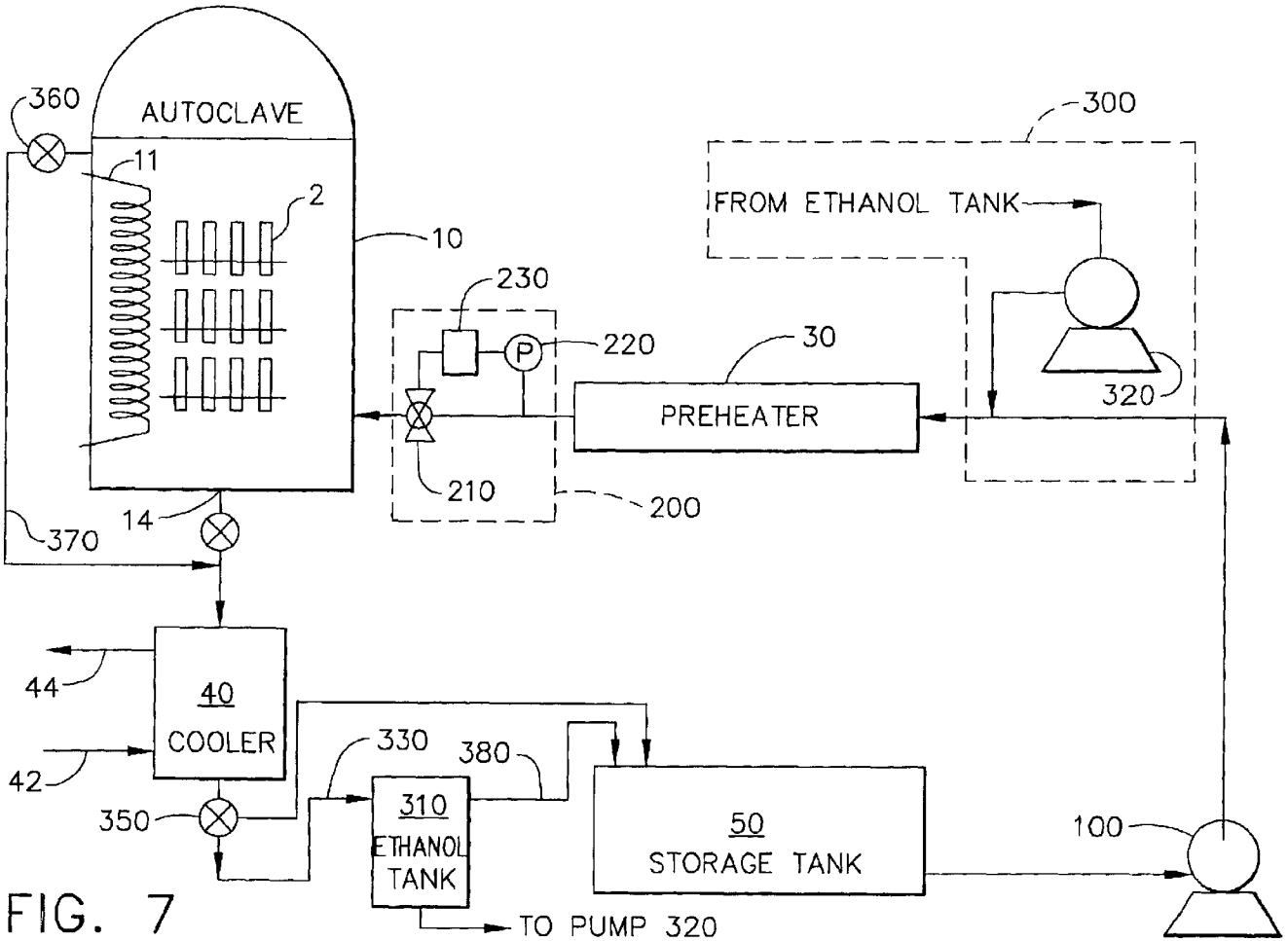
FIG. 7 is a detailed schematic of a volatiles recovery and reuse system.

At the end of the temperature/pressure cycle in autoclave 10, it is desirable to recover or capture the volatile fluid used to pre-pressurize autoclave 10 so that it can be reused. FIG. 1 includes a volatile fluid capture and reuse loop which is shown in more detail in FIG. 7. A line 370 in the form of piping is connected to the head space above articles 2 in autoclave 10. Line 370 is isolated from headspace by valve 360 which is switchable from a closed position to an open position to permit the volatile fluid flow from the head space. At the conclusion of the temperature/pressure cycle, valve 360 is open allowing gaseous volatile fluid to flow through line 370, thereby reducing autoclave pressure while allowing the volatile fluid to flow from headspace to cooler 40, where it is condensed. The condensed volatile then can be directed by valve 350, switchable to control the discharge from cooler 40 to either reagent storage tank or volatile fluid constant head tank 310. Excess volatiles can also be directed from ethanol constant head tank 310 through line 380 where it can be mixed with reagent 52.

Because the articles in the autoclave are both hot and coated with caustic material, sodium hydroxide in the preferred embodiment, it is necessary to both effectively remove the caustic material deposited thereon and cool the articles. Because the articles are typically components used in turbine applications, such as airfoils, blades and vanes, combustors and the like, they typically include intricate, fine internal passages for cooling. The deposits are difficult to remove from these passages, but cannot be left in place as they can cause accelerated degradation of the articles when returned to turbine engine service.

Figure 8:
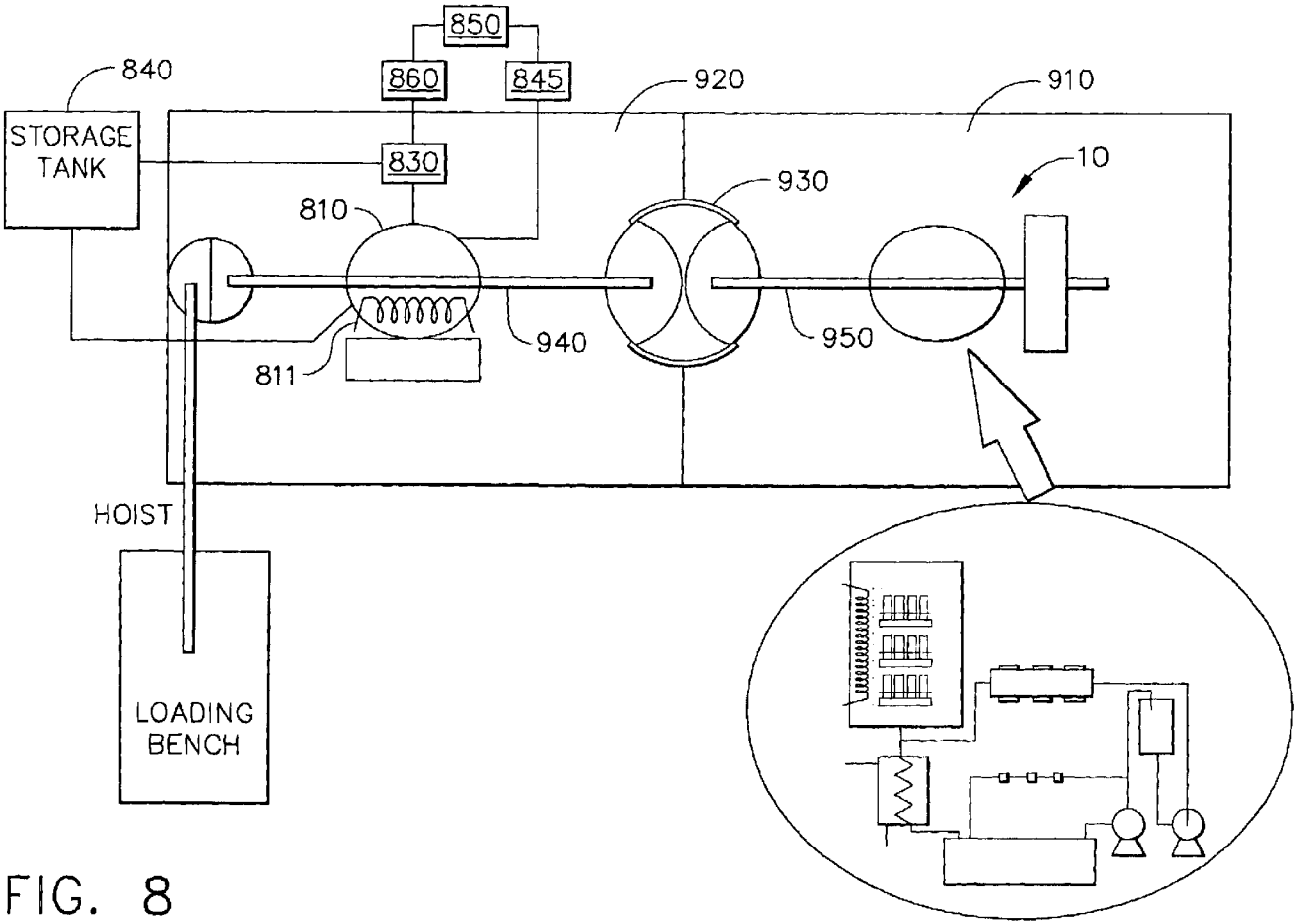
FIG. 8 is a schematic of a rinse system assembled in series with the advanced autoclave system of the present invention.

While it is necessary to remove the deposits, the increased efficiency of the present invention results from dedicating autoclave 10 to removing surface materials such as surface coatings and oxides from the substrate, while avoiding cooling and cleaning cycles within dedicated autoclave. Referring now to FIG. 8, this problem is overcome by dedicating a second pressure vessel or autoclave to rinsing the stripped blades. The hot, stripped turbine components having caustic material on their surfaces are transferred from autoclave 10 to a second autoclave, depicted in FIG. 8. This transfer now makes autoclave 10 available for the next cycle of operation. Autoclave 810 is capable of heating water to temperatures in the range of 100–250° C., while maintaining pressures of from about 5 to 1000 psi. Autoclave 810 is preferably preheated by any convenient heat source such as resistance heaters, steam coils or induction heaters. Gases are evacuated from autoclave by vacuum pump (not shown). After a predetermined reduced pressure has been achieved, superheated water at a temperature of about 150° C., preheated in a pre-heater 830, is introduced into evacuated autoclave 810, thereby raising the pressure as a portion of it flashes to steam. The introduction of water into the internal passages of the articles is facilitated by the evacuation process, as the water is drawn into the passageways, where it can contact and dissolve residual alkaline hydroxide. After a period of time sufficient to permit the dissolution of the alkaline hydroxide, the pressure in autoclave 810 is released or burped. This causes the boiling of the superheated water and the generation of steam in the internal passages. The steam forces water having dissolved alkaline hydroxide from the internal passages. The vessel is then sealed and the process is repeated. While this process is occurring, vessel 810 is ultrasonically agitated to assist in the removal of retained soils and loose ceramic material from the surfaces of the articles. The vessel is then drained of the contaminated water, and the process is repeated with clean water. The process is repeated several times, as required. At the conclusion of the water rinse cycles, a predetermined quantity of weak organic acid which does not affect the substrate and which reacts with the alkaline hydroxide is introduced from a storage tank 840 into the pre-heater where it is preheated and introduced into autoclave 810. Preferred dilute acids include acetic acid and citric acid. This superheated dilute acid is introduced to neutralize any remaining caustic material. After a predetermined amount of time, the acid solution is removed from autoclave 810 and a final water rinse as set forth above is given to the articles.

The sequence of processing is effective in reducing the amount of retained alkaline material in the articles. In order to minimize the amount of waste and to reuse the water, the condensed water can be recycled by filtering out any particles with a filter 845 or series of filters and then passing it through an ion exchanger 850, after which it can be sent to storage tank 860 for reuse. The dilute acetic acid can be returned to tank 840 where its strength can be monitored and adjusted as required. In the preferred method of practicing the invention, autoclave 10 is maintained within an isolatable nitrogen chamber 910 and autoclave 810 which acts as a rinse vessel is outside of the isolatable nitrogen chamber, 910 in an ambient pressure region, which may be any atmospheric region external to the nitrogen region, depicted as 920. Between nitrogen chamber 910 and region 920 is a nitrogen lock 930. The chamber 910 is purged with nitrogen during operation to thereby eliminate oxygen and reduce the possibilities of mixing oxygen with any of the gaseous, flammable reagents used in the stripping operation. Mechanical handling systems 940, 950 are provided to facilitate the loading and unloading of articles into each of autoclaves 10 and 810. Other materials handling systems, examples of which are shown in FIG. 8 are desirable but are not absolutely necessary to carry out the principles of the present invention, may be added as needed to assist in the smooth flow and operation of articles and materials through the system.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. Analysis equipment for determining a chemistry of an organic component and a caustic component of a reusable organic caustic solution, the analysis equipment comprising:

an autoclave containing a metallic component and the reusable organic caustic solution at elevated temperature and pressure, the reusable organic caustic solution having been utilized for at least one cycle of removing a ceramic coating from the metallic component;

a storage tank for storing, the reusable organic caustic solution after removal from the autoclave;

a filter for removing particles of the ceramic coating dispersed in the reusable organic caustic solution from the reusable organic caustic solution;

a pump for circulating the reusable organic caustic solution from the tank through the filter;

a pipe connecting the storage tank to the pump, the pump to the filter and the filter to the storage tank; and at least two sensors positioned between the filter and the storage tank to measure at least two physical properties of the reusable organic caustic solution after removal of the particles from the reusable organic caustic solution, the at least two physical properties selected from the group consisting of electrical conductivity, opacity, refractive index, density, fluidity and the speed of sound in the solution.

2. The analysis equipment of claim 1 further including a readout for monitoring the physical properties measured by the at least two sensors.

3. The analysis equipment of claim 2 wherein the readout is an analogue readout.

4. The analysis equipment of claim 2 wherein the readout is a digital readout.

5. The analysis equipment of claim 4 further including a computer connected to the digital readout for monitoring and storing the measured physical properties.

6. The analysis equipment of claim 2 further including a storage medium for storing the measured physical properties.

7. Analysis equipment for determining a concentration of an organic component and a caustic component of a reusable organic caustic solution, the analysis equipment comprising:

an autoclave containing a metallic component and the reusable organic caustic solution at elevated temperature and pressure, the reusable organic caustic solution having been utilized for at least one cycle of removing a ceramic coating from the metallic component;

a storage tank for storing the reusable organic caustic solution after removal from the autoclave;

a filter for removing particles of the ceramic coating dispersed in the reusable organic caustic solution from the reusable organic caustic solution;

a pump for circulating the reusable organic caustic solution from the tank through the filter;

a pipe connecting the storage tank to the pump, the pump to the filter and the filter to the storage tank; and at least two sensors positioned between the filter and the storage tank, each of the at least two sensors for measuring a different physical property of the reusable organic caustic solution after removal of the particles from the reusable organic caustic solution, the physical property associated with the concentration of at least one of the organic component and the caustic component of the reusable organic caustic solution, the physical property selected from the group consisting of electrical conductivity, opacity, refractive index, density, fluidity and the speed of sound in the solution.

8. The analysis equipment of claim 7 wherein one of the at least two sensors measure electrical conductivity.

9. The analysis equipment of claim 7 wherein one of the at least two sensors measure opacity.

10. The analysis equipment of claim 7 wherein one of the at least two sensors measure refractive index.

11. The analysis equipment of claim 7 wherein one of the at least two sensors measure density.

12. The analysis equipment of claim 7 wherein one of the at least two sensors measure fluidity.

13. The analysis equipment of claim 7 wherein one of the at least two sensors measure the speed of sound.

14. The analysis equipment of claim 7 further including a readout for monitoring the physical properties measured by one of the at least two sensors.

15. The analysis equipment of claim 14 wherein the readout is an analogue readout.

16. The analysis equipment of claim 14 wherein the readout is a digital readout.

17. The analysis equipment of claim 16 further including a computer connected to the digital readout for monitoring and storing the physical properties measured by one of the at least two sensors.

18. The analysis equipment of claim 14 further including a storage medium for storing the physical properties measured by one of the at least two sensors.

* * * * *